US011688565B2

(12) United States Patent
Chen et al.

(10) Patent No.: US 11,688,565 B2
(45) Date of Patent: Jun. 27, 2023

(54) GROUND FAULT CIRCUIT BREAKER PROTECTOR FOR WRONG WIRING POWER-OFF PROTECTION

(71) Applicant: Jiangsu Barep intelligence Technology Co., Ltd, Zhangjiagang (CN)

(72) Inventors: Jiangang Chen, Zhangjiagang (CN); Xiaobo Zheng, Zhangjiagang (CN)

( * ) Notice: Subject to any disclaimer, the term of this patent is extended or adjusted under 35 U.S.C. 154(b) by 0 days.

(21) Appl. No.: 17/450,559

(22) Filed: Oct. 12, 2021

(65) Prior Publication Data

US 2022/0310333 A1 Sep. 29, 2022

(30) Foreign Application Priority Data

Sep. 24, 2021 (CN) ..... 202111125207.8

(51) Int. Cl.
*H01H 1/14* (2006.01)
*H01H 3/38* (2006.01)
*H01H 71/50* (2006.01)

(52) U.S. Cl.
CPC ..... *H01H 1/14* (2013.01); *H01H 3/38* (2013.01); *H01H 71/50* (2013.01); *H01H 2235/01* (2013.01)

(58) Field of Classification Search
CPC ..... H01H 1/14; H01H 3/38; H01H 71/50; H01H 2235/01
USPC ..... 200/238; 361/634–636
See application file for complete search history.

(56) References Cited

U.S. PATENT DOCUMENTS

| | | | | |
|---|---|---|---|---|
| 10,115,553 | B1 * | 10/2018 | Chen | H01H 71/68 |
| 2002/0180451 | A1 | 12/2002 | Leopold et al. | |
| 2008/0123226 | A1 | 5/2008 | McGinn et al. | |
| 2018/0261993 | A1 | 9/2018 | Kurniawan | |

* cited by examiner

*Primary Examiner* — Edwin A. Leon
*Assistant Examiner* — Iman Malakooti
(74) *Attorney, Agent, or Firm* — Rumit Ranjit Kanakia

(57) ABSTRACT

The present disclosure discloses a ground fault circuit breaker protector for wrong wiring power-off protection, and belongs to the technical field of ground fault circuit breaker protectors. The ground fault circuit breaker protector includes two conductors fixedly mounted inside a shell. One of the conductors is a power input end; and a line output end is electrically connected to a load output end through a transfer relay and forms the other conductor. The ground fault circuit breaker protector further includes a reset mechanism and a movement arm. By means of pressing the RESET push rod, the push rod is locked on the sliding block by the buckle; under the elastic action of the first springs and the second spring, the sliding block pushes the movement arm to contact the line output end and the load output end.

7 Claims, 6 Drawing Sheets

GROUND FAULT CIRCUIT BREAKER PROTECTOR FOR WRONG WIRING POWER-OFF PROTECTION

TECHNICAL FIELD

The present disclosure belongs to the technical field of ground fault circuit break protector, and particularly relates to a ground fault circuit breaker protector for wrong wiring power-off protection.

BACKGROUND

A ground fault circuit breaker (GFCI) is a novel circuit breaker. This type of circuit breaker can not only prevent damage to house wiring, but also protect people from electric shocks. After this situation is detected, a circuit will be cut off immediately to prevent electric shock and casualties. Since the GFCI can take action before the current rises to a dangerous level, its response speed is much higher than that of a traditional circuit breaker. Fast and sensitive circuit breaking is the key to the GFCI.

The Chinese patent (CN201510676381.X) discloses a safety ground fault circuit breaker and a control method therefor. The circuit breaker includes a base, an upper cover, a bracket reset mechanism, an electromagnetic trip mechanism, an anti-misconnection mechanism, a contact assembly, a ground assembly, a power input connection assembly, an output connection assembly, a printed circuit board (PCB), and a circuit breaker circuit arranged on the PCB. The circuit breaker circuit includes a power supply circuit, a leakage ground detection circuit, a signal amplification and shaping circuit, a single-chip microcomputer control circuit, a power detection and work instruction circuit, a trip mechanism control circuit, and a wrong wiring protection circuit. The anti-misconnection mechanism includes an anti-misconnection electromagnet and a limiting structure arranged on a reset rod and matched with a front end of an anti-misconnection iron core of the anti-misconnection electromagnet.

At present, the ground fault circuit breaker only controls the opening and closing of a circuit by only means of controlling opening and closing of a metal contact, which results in a slow circuit breaker response.

SUMMARY

The present disclosure aims to provide a ground fault circuit breaker protector for wrong wiring power-off protection to solve the problem that the opening and closing of a circuit are controlled by means of opening and closing of a conventional metal contact, which results in a slow circuit breaker response.

In order to achieve the above purpose, the present disclosure adopts the following technical solution: a ground fault circuit breaker protector for wrong wiring power-off protection includes two conductors fixedly mounted inside a shell. One of the conductors is a power input end; and a line output end is electrically connected to a load output end through a transfer relay and forms the other conductor. The ground fault circuit breaker protector further includes a reset mechanism and a movement arm. The movement arm is downwards inclined; one end of the movement arm is fixedly connected to the power input end, and the other end of the movement arm contacts the line output end and the load output end from the bottom; the movement arm is electrically connected to the line output end and the load output end; the reset mechanism is slidably arranged in the shell; the lower end of the reset mechanism supports the bottom surface of the movement arm; and the transfer relay is fixedly mounted on the shell.

As a further description of the above-mentioned technical solution:

an end part of the movement arm is provided with two first contacts; the line output end and the load output end are both provided with second contacts; and the two first contacts respectively contact the two second contacts.

As a further description of the above-mentioned technical solution:

the load output end is located above the power input end and the load output end; the bottom of the load output end is provided with a first bent end; the line output end is provided with a second bent end; and the two second contacts are fixedly mounted on the first bent end and the second bent end, respectively.

As a further description of the above-mentioned technical solution:

a limiting pillar is arranged in the shell, and resists against the bottom surface of the movement arm.

As a further description of the above-mentioned technical solution:

the reset mechanism includes a push rod, a sliding block, a buckle, and a trip mechanism; the sliding block is slidably arranged in the shell; the push rod slides in the shell; the push rod is plugged into the sliding block; the buckle is plugged into the sliding block from the side surface of the sliding block the buckle locks the lower end part of the push rod; the trip mechanism is clamped with the buckle; the trip mechanism is located on one side of the buckle; and the sliding block supports the bottom surface of the movement arm.

As a further description of the above-mentioned technical solution:

two first springs are sleeved on the push rod; a transverse plate is arranged in the shell; two opposite ends of one of the first springs are fixedly connected to the upper end part of the push rod and the transverse plate, respectively; two opposite ends of the other first spring are fixedly connected to the transverse plate and the sliding block, respectively; and a second spring is arranged between the sliding block and the bottom surface of the shell.

As a further description of the above-mentioned technical solution:

the bottom of the shell is provided with a touch switch, and the sliding block presses the touch switch.

As a further description of the above-mentioned technical solution:

the movement arm is a metal clip.

In summary, the above-mentioned technical solution is used, so that the present disclosure has the beneficial effects as follows.

In the present disclosure, by means of pressing the RESET push rod, the push rod is locked on the sliding block by the buckle; under the elastic action of the first spring and the second spring, the sliding block pushes the movement arm to contact the line output end and the load output end. After the transfer relay obtains power supplied by the line output end, a normally-closed contact is closed so that there is a closed circuit between the line output end and the load output end. When there is a fault in a line, the trip mechanism pulls the buckle to relieve the limitation to the push rod. The sliding block leaves the movement arm under the elastic action so that the movement arm is separated from the line output end and the load output end. After the transfer relay loses the power supplied by the line output end, the normally-closed contact is opened, so that there is an open circuit between the line output end and the load output end, which achieves a dual circuit breaker response effect. The problem of slow circuit breaker response is solved. It is favorable for fast circuit breaker protection for the circuit.

1: shell; 2: power input end; 3: line input end; 4: load output end; 5: reset mechanism; 51: push rod; 52: sliding block; 53: buckle; 54: trip mechanism; 6: movement arm; 7: transfer relay; 8: first contact; 9: second contact; 10: first bent end; 11: second bent end; 12: limiting pillar; 13: first spring; 14: transverse plate; 15: second spring; 16: touch switch.

DETAILED DESCRIPTION OF THE EMBODIMENTS

The following clearly and completely describes the technical solution in the embodiments of the present disclosure in combination with the accompanying drawings of the embodiments of the present disclosure. Apparently, the described embodiments are only part of the embodiments of the present disclosure, not all embodiments. Based on embodiments of the present disclosure, all other embodiments obtained by those of ordinary skill in the art without creative work shall fall within the scope of protection of the present disclosure.

Figure 1:
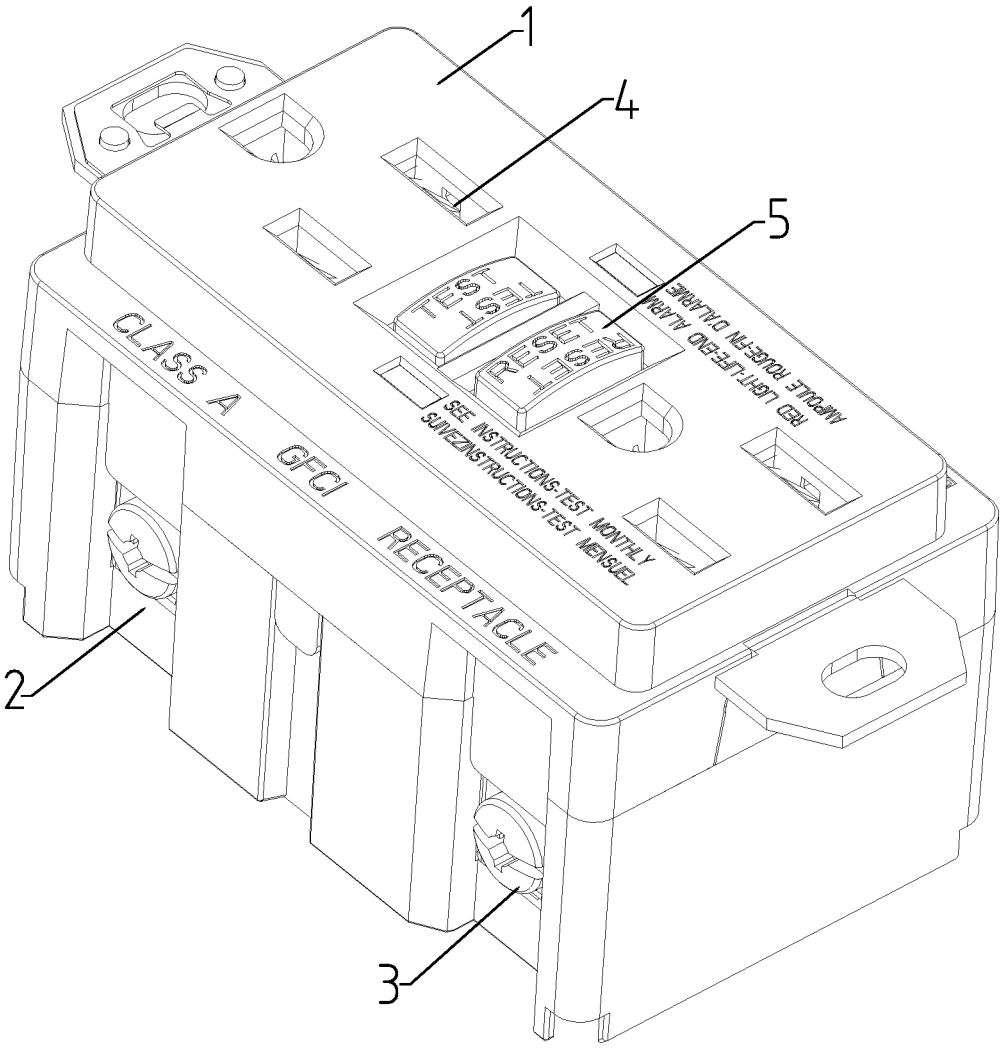
FIG. 1 is a schematic diagram of an entire structure of a ground fault circuit breaker protector for wrong wiring power-off protection.
Figure 2:
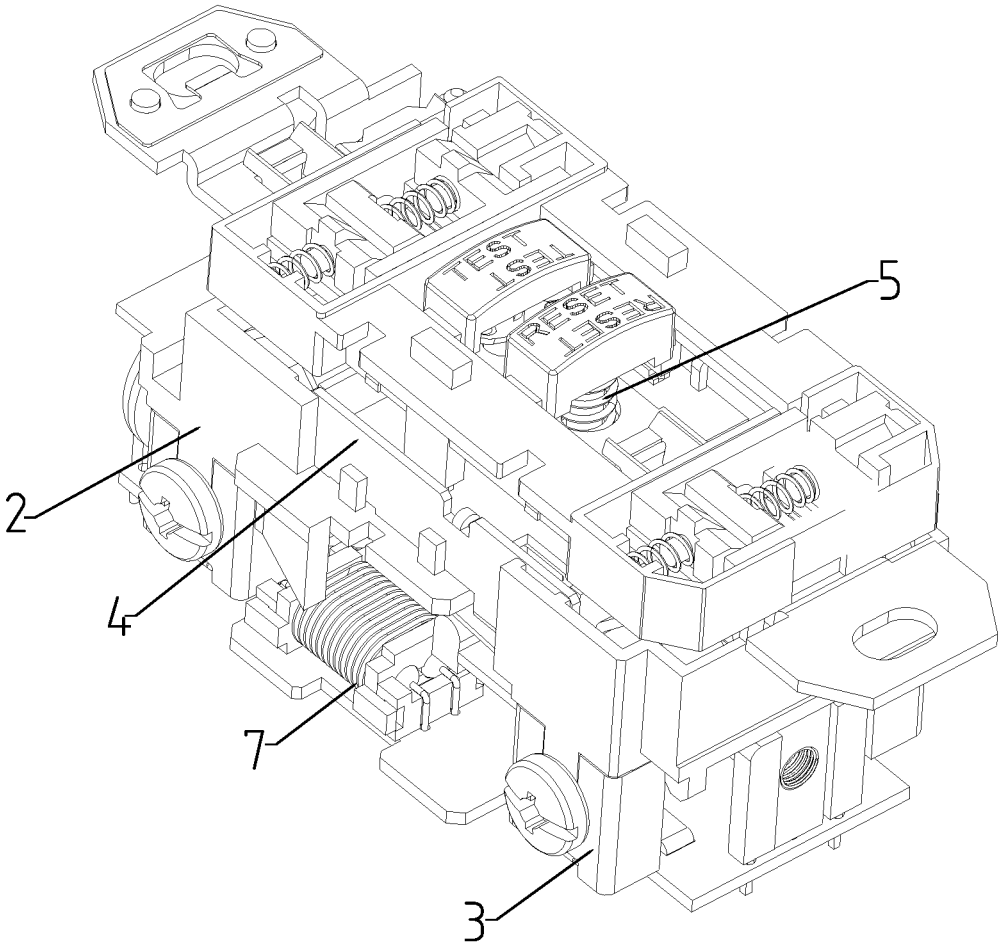
FIG. 2 is a schematic diagram I of an internal structure of a ground fault circuit breaker protector for wrong wiring power-off protection.
Figure 3:
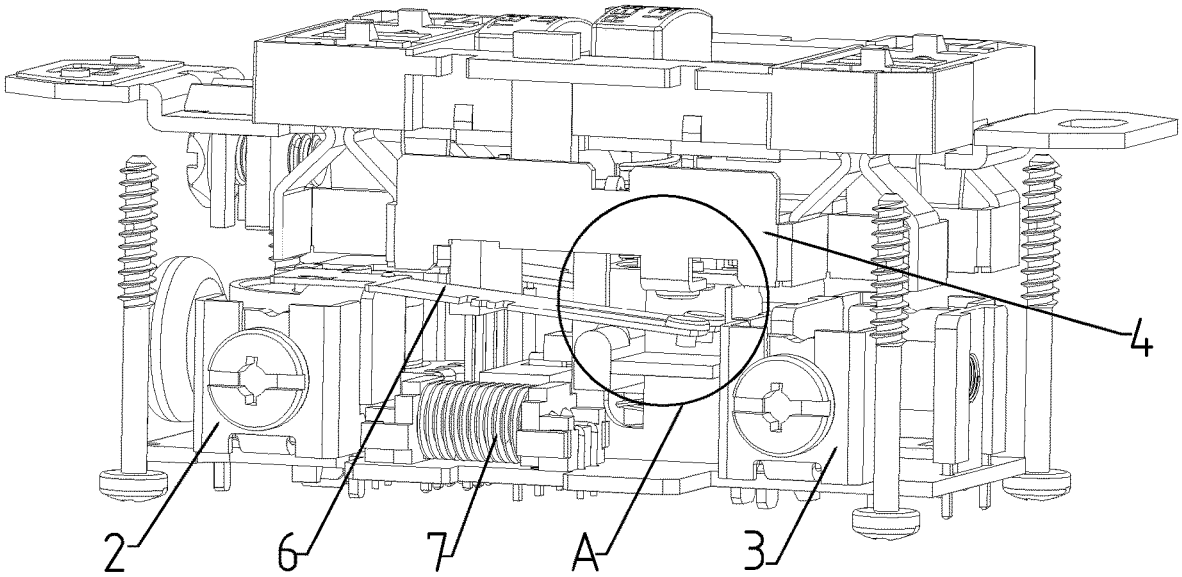
FIG. 3 is a schematic diagram II of an internal structure of a ground fault circuit breaker protector for wrong wiring power-off protection.
Figure 4:
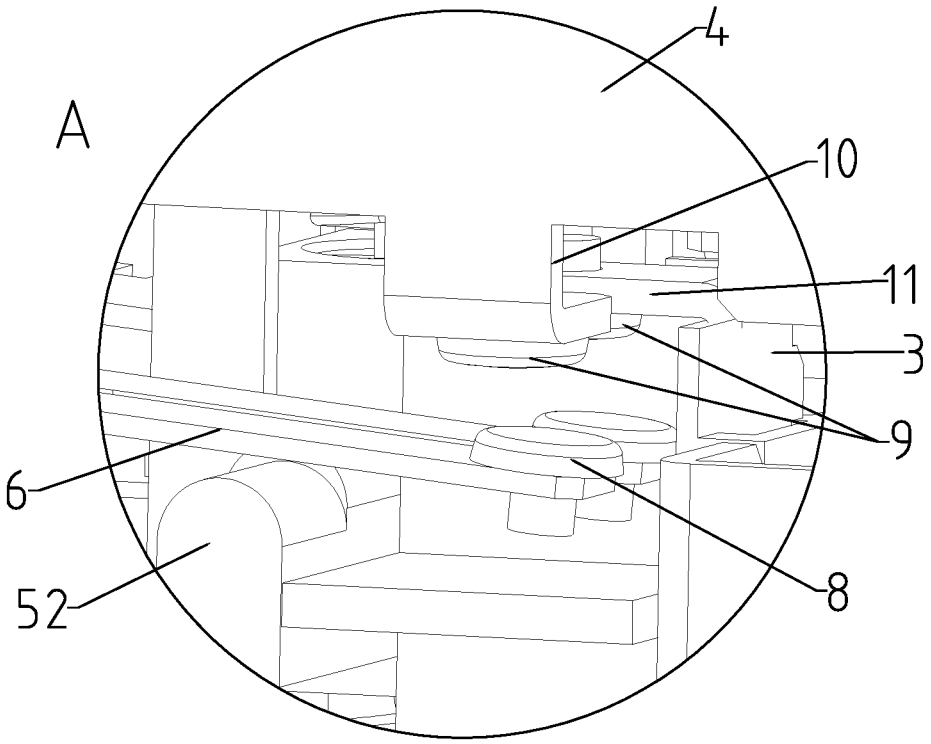
FIG. 4 is a partially enlarged diagram of the part A in FIG. 3.
Figure 5:
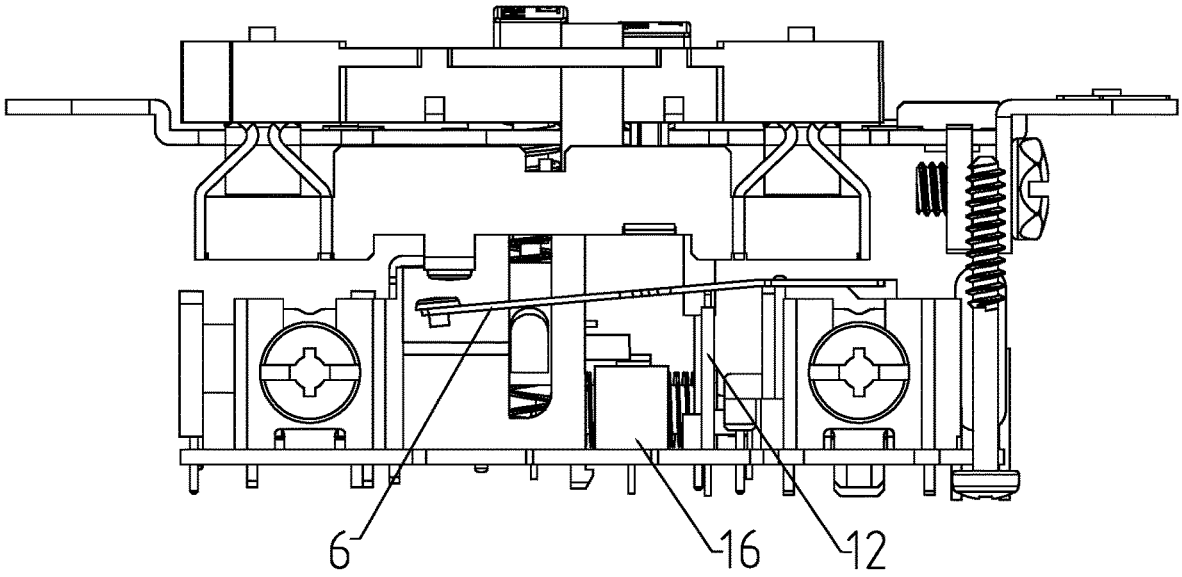
FIG. 5 is a schematic diagram III of an internal structure of a ground fault circuit breaker protector for wrong wiring power-off protection.
Figure 6:
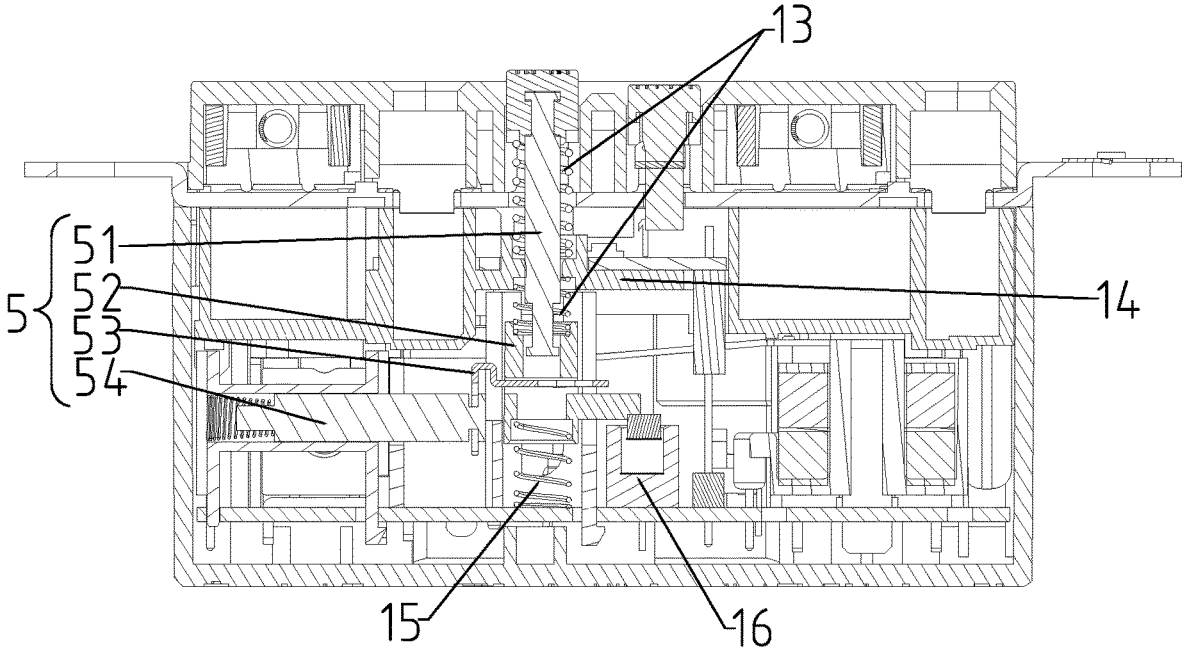
FIG. 6 is a sectional diagram of a ground fault circuit breaker protector for wrong wiring power-off protection.

Referring to FIGS. 1-6, the present disclosure provides one technical solution: a ground fault circuit breaker protector for wrong wiring power-off protection, including two conductors fixedly mounted inside a shell 1. One of the conductors is a power input end 2; and a line output end 3 is electrically connected to a load output end 4 through a transfer relay 7 and forms the other conductor. The ground fault circuit breaker protector further includes a reset mechanism 5 and a movement arm 6. The movement arm 6 is downwards inclined; one end of the movement arm 6 is fixedly connected to the power input end 2, and the other end of the movement arm 6 contacts the line output end 3 and the load output end 4 from the bottom; the movement arm 6 is electrically connected to the line output end 3 and the load output end 4; the reset mechanism 5 is slidably arranged in the shell 1; the lower end of the reset mechanism 5 supports the bottom surface of the movement arm 6; and the transfer relay 7 is fixedly mounted on the shell 1.

An end part of the movement arm 6 is provided with two first contacts 8; the line output end 3 and the load output end 4 are both provided with second contacts 9; and the two first contacts 8 respectively contact the two second contacts 9. The deformation of the movement arm 6 will enable the first contacts 8 and the second contacts 9 to be frequently opened and closed, which is favorable for the electrical connection between the two conductors.

The load output end 4 is located above the power input end 2 and the load output end 4; the bottom of the load output end 4 is provided with a first bent end 10; the line output end 3 is provided with a second bent end 11; and the two second contacts 9 are fixedly mounted on the first bent end 10 and the second bent end 11, respectively. The layout structure between the two conductors is optimized so that when the movement arm 6 does deformation motion, electrical connection is quickly established between the two conductors, and the conductors will not interfere with each other, and will not interfere with the deformation of the movement arm 6.

A limiting pillar 12 is arranged in the shell 1, and resists against the bottom surface of the movement arm 6. The limiting pillar 12 plays a limiting role for the deformation of the movement arm 6, so as to prevent excessive deformation of the movement arm 6.

The reset mechanism 5 includes a push rod 51, a sliding block 52, a buckle 54, and a trip mechanism 54; the sliding block 52 is slidably arranged in the shell 1; the push rod 51 slides in the shell 1; the push rod 51 is plugged into the sliding block 52; the buckle 53 is plugged into the sliding block 52 from the side surface of the sliding block 52; the buckle 53 locks the lower end part of the push rod 51; the trip mechanism 54 is clamped with the buckle 53; the trip mechanism 54 is located on one side of the buckle 53; and the sliding block 52 supports the bottom surface of the movement arm 6. The push rod 51 is pushed to be plugged into the sliding block 52. The push rod 51 is then continued to be pushed to be plugged into the buckle 53, such that the push rod 51 pulls the sliding block 52 to slide. The sliding block 51 upwards slides to drive the movement arm 6 to deform. The trip mechanism 54 pulls the buckle 53 to slide in the sliding block 52, such that the buckle 53 releases the limitation to the push rod 51, and the push rod 51 is separated from the sliding block 52. The sliding of the push rod 51 no longer controls the sliding block 52 to drive the movement arm 6 to deform.

Two first springs 13 are sleeved on the push rod 51; a transverse plate 14 is arranged in the shell 1; two opposite ends of one of the first springs 13 are fixedly connected to the upper end part of the push rod 51 and the transverse plate 14, respectively; two opposite ends of the other first spring 13 are fixedly connected to the transverse plate 14 and the sliding block 52, respectively; and a second spring 15 is arranged between the sliding block 52 and the bottom surface of the shell 1.

The bottom of the shell 1 is provided with a touch switch 16, and the sliding block 52 presses the touch switch 16.

The movement arm 6 is a metal clip and has the characteristic of elastic deformation and the characteristic of electricity conductivity.

The working principle: Firstly, the power input end 2 and the line output end 3 are respectively connected to the line. The push rod 51 is pressed and then slides along the shell 1. The lower end part of the push rod 51 is plugged into the sliding block 52. The push rod 51 continues to slide down, is plugged into the buckle 53, and is locked on the sliding block 52 by the buckle 53, such that the sliding of the sliding block 52 and the sliding of the push rod 51 can be synchronously in the subsequent process. The sliding block 52 touches the touch switch 16 to initiate a reset circuit. The two first springs 13 and the second spring 15 are compressed. Secondly, the pushing on the push rod 51 is stopped, and the compressed first springs 13 and the second spring 15 are upwards elastically rebounded. The first springs 13 act on the push rod 51, and the second spring 15 acts on the sliding block 52, such that the push rod 51 and the sliding block 52 synchronously slide up. The sliding block 52 acts on the movement arm 6 to deform upwards. The two first contacts 8 on the movement arm 6 respectively touch the second contact 9 on the first bent end 10 and the second contact 9 on the second bent 11. At this time, the movement arm 6 communicates with the power input end 2, the line output end 3, and the load output end 4. The line output end 3 and the load output end 4 supply power. At this time, the transfer relay 7 obtains the power supplied by the line output end 3, and the normally-closed contact of the transfer relay 7 is opened. The line output end 3 and the load output end 4 are switched on to enable the load output end 4 to continuously obtain the supplied power. Next, when the circuit has electricity leakage, the trip mechanism 54 works and pulls the buckle 53 to slide towards one side of the sliding block 52, and the buckle 53 relieves the clamping limitation to the end part of the push rod 51. The push rod 51 slides upwards under the action of the first springs 13, and the sliding block 52 separated from the push rod 51 slides downwards under the action of the second spring 15. The sliding block 52 no longer resists against the movement arm 6, and the movement arm 6 elastically deforms. The first contacts 8 on the movement arm 6 are separated from the second contacts 9, and the line output end 3 and the load output end 4 are separated. The line output end 3 loses the power supplied to the transfer relay 7, and the normally-closed contact of the transfer relay 7, so as to control the line output end 3 and the load output end 4 to be switched off. Finally, the load output end 4 is powered off.

The above descriptions are only specific preferred implementation modes of the present disclosure, but the scope of protection of the present disclosure is not limited thereto. For any person skilled in the art, within the technical scope disclosed by the present disclosure, equivalent substitutions or changes made according to the technical solution of the present disclosure and an inventive idea of the present disclosure shall all fall within the scope of protection of the present disclosure.

What is claimed is:

1. A ground fault circuit breaker protector for wrong wiring power-off protection, comprising two conductors fixedly mounted inside a shell (1), wherein one of the conductors is a power input end (2); and a line output end (3) is electrically connected to a load output end (4) through a transfer relay (7) and forms the other conductor;

the ground fault circuit breaker protector further includes a reset mechanism (5) and a movement arm (6); the movement arm (6) is downwards inclined; one end of the movement arm (6) is fixedly connected to the power input end (2), and the other end of the movement arm (6) contacts the line output end (3) and the load output end (4) from the bottom; the movement arm (6) is electrically connected to the line output end (3) and the load output end (4); the reset mechanism (5) is slidably arranged in the shell (1); the lower end of the reset mechanism (5) supports the bottom surface of the movement arm (6); and the transfer relay (7) is fixedly mounted on the shell (1);

wherein the reset mechanism (5) comprises a push rod (51), a sliding block (52), a buckle (53), and a trip mechanism (54); the sliding block (52) is slidably arranged in the shell (1); the push rod (51) slides in the shell(1); the push rod (51) is plugged into the sliding block (52); the buckle (53) is plugged into the sliding block (52) from the side surface of the sliding block (52); the buckle (53) locks the lower end part of the push rod (51); the trip mechanism(54) is clamped with the buckle (53); the trip mechanism (54) is located on one side of the buckle (53); and the sliding block (52) supports the bottom surface of the movement arm (6).

2. The ground fault circuit breaker protector for wrong wiring power-off protection according to claim 1, wherein an end part of the movement arm (6) is provided with two first contacts (8); the line output end (3) and the load output end (4) are both provided with second contacts (9); and the two first contacts (8) respectively contact the two second contacts (9).

3. The ground fault circuit breaker protector for wrong wiring power-off protection according to claim 2, wherein the load output end (4) is located above the power input end (2) and the load output end (4); the bottom of the load output end (4) is provided with a first bent end (10); the line output end (3) is provided with a second bent end (11); and the two second contacts (9) are fixedly mounted on the first bent end (10) and the second bent end (11), respectively.

4. The ground fault circuit breaker protector for wrong wiring power-off protection according to claim 1, wherein a limiting pillar (12) is arranged in the shell (1), and resists against the bottom surface of the movement arm (6).

5. The ground fault circuit breaker protector for wrong wiring power-off protection according to claim 1 wherein two first springs (13) are sleeved on the push rod(51); a transverse plate (14) is arranged in the shell (1); two opposite ends of one of the first springs (13) are fixedly connected to the upper end part of the push rod (51) and the transverse plate (14), respectively; two opposite ends of the other first spring (13) are fixedly connected to the transverse plate (14) and the sliding block (52), respectively; and a second spring (15) is arranged between the sliding block (52) and the bottom surface of the shell (1).

6. The ground fault circuit breaker protector for wrong wiring power-off protection according to claim 1, wherein the bottom of the shell (1) is provided with a touch switch (16), and the sliding block (52) presses the touch switch (16).

7. The ground fault circuit breaker protector for wrong wiring power-off protection according to claim 1, wherein the movement arm (6) is a metal clip.

* * * * *